US008434504B2

(12) United States Patent
Simonette et al.

(10) Patent No.: US 8,434,504 B2
(45) **Date of Patent: *May 7, 2013**

(54) APPARATUS AND METHOD FOR CLEANING SURFACES

(76) Inventors: Dallas W. Simonette, Las Vegas, NV (US); Michael R. Lange, Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/660,246

(22) Filed: Feb. 22, 2010

(65) Prior Publication Data

US 2011/0180098 A1 Jul. 28, 2011

Related U.S. Application Data

(63) Continuation of application No. 12/218,347, filed on Jul. 14, 2008, and a continuation-in-part of application No. 10/982,505, filed on Nov. 5, 2004, now Pat. No. 7, 665,173.

(51) Int. Cl.
*B08B 3/00* (2006.01)

(52) U.S. Cl.
USPC ..... 134/172; 134/198; 15/49.1; 15/98; 15/103

(58) Field of Classification Search ..... 134/172, 134/198, 199; 15/49.1, 50.1, 50.2, 50.3, 15/52, 52.1, 52.2, 88.4, 98, 103
See application file for complete search history.

(56) References Cited

U.S. PATENT DOCUMENTS

| | | | | |
|---|---|---|---|---|
| 3,080,592 | A * | 3/1963 | Hassage | 15/98 |
| 3,108,301 | A | 10/1963 | Jones | |
| 3,292,193 | A | 12/1966 | Littin | |
| 3,298,052 | A | 1/1967 | Wolfe | |
| 3,344,454 | A | 10/1967 | Mikalson | |
| 4,198,724 | A | 4/1980 | Fisher et al. | |
| 4,426,751 | A * | 1/1984 | Nordeen | 15/384 |
| 5,014,803 | A | 5/1991 | Urakami | |
| 5,201,090 | A * | 4/1993 | Jans | 15/88.4 |
| 5,249,326 | A | 10/1993 | Jefferies | |
| 5,707,455 | A | 1/1998 | Tomita | |
| 5,715,557 | A | 2/1998 | Hsu | |
| 5,890,250 | A | 4/1999 | Lange et al. | |
| 5,901,720 | A | 5/1999 | Lange | |
| 6,016,924 | A * | 1/2000 | Caliva | 210/528 |

(Continued)

FOREIGN PATENT DOCUMENTS

EP 0271454 6/1988

OTHER PUBLICATIONS

A. Nishi, Computer Elect. Engng, Elsevier Science Ltd., vol. 22, No. 2 pp. 123-149, 1996.

*Primary Examiner* — Eric Golightly

(74) *Attorney, Agent, or Firm* — Richard John Bartz

(57) ABSTRACT

A cleaning apparatus and method for cleaning generally upright surfaces, walls and windows of a building has a frame rotatably supporting one or more brushes adapted to engage the upright surface of a building. A davit supported on top of the building is connected to a cable pendently supporting the frame and brushes. A winch driven with a motor mounted on the frame operably connected to the cable operates to move the frame and brushes relative to the upright surface. A counterforce generator mounted on the frame establishes a force on the frame and brushes that maintains the brushes in effective continuous engagement with the upright surface during cleaning thereof.

20 Claims, 10 Drawing Sheets

U.S. PATENT DOCUMENTS

| | | | | |
|---|---|---|---|---|
| RE36,649 | E | 4/2000 | Jefferies et al. | |
| 6,090,221 | A | 7/2000 | Gan et al. | |
| 6,120,262 | A * | 9/2000 | McDonough et al. | 417/424.1 |
| 6,158,678 | A | 12/2000 | Lange | |
| 6,170,109 | B1 | 1/2001 | Jesadanont et al. | |
| 6,550,090 | B1 | 4/2003 | Jesadanont et al. | |
| 6,601,256 | B2 | 8/2003 | Lee | |
| 6,802,098 | B2 | 10/2004 | Geyer et al. | |
| 6,910,678 | B2 * | 6/2005 | Small | 254/334 |
| 7,093,318 | B2 | 8/2006 | Konrad | |
| 7,523,517 | B2 | 4/2009 | Yu | |
| 2003/0106176 | A1 | 6/2003 | Wang | |
| 2006/0096050 | A1 | 5/2006 | Simonette | |
| 2009/0044833 | A1 | 2/2009 | Simonette | |
| 2009/0100618 | A1 | 4/2009 | Chen | |

* cited by examiner

APPARATUS AND METHOD FOR CLEANING SURFACES

CROSS REFERENCE TO RELATED APPLICATION

This application is a continuation of U.S. patent application Ser. No. 12/218,347 filed Jul. 14, 2008 and a continuation in part of U.S. patent application Ser. No. 10/982,505 filed Nov. 5, 2004, now U.S. Pat. No. 7,665,173.

FIELD OF THE INVENTION

The present invention relates to cleaning systems, particularly liquid application cleaning apparatus and methods for cleaning windows and walls of structures, such as buildings.

BACKGROUND OF THE ART

Building structures, particularly tall urban buildings, are typically washed manually. A scaffolding structure is usually suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure may be repeated until the entire building has been washed. Cleaning windows using scaffolding is extremely time consuming. In an effort to reduce time and cost, therefore being more competitive in the industry, window washers tie a climbing rope to the roof anchors provided for the scaffolding and throw the rope over the side of the building. Then they attach a bosons chair to the rope and a climber's harness to themselves with repelling hardware. The man goes over the side of the building with his tools and water/soap bucket and cleans 6-8 of horizontal glass width per story. Then repels down to the next level and repeats until that drop is complete.

Manual washing of buildings has proven to be quite dangerous, especially with respect to tall skyscrapers. Typical wind and air drafts surrounding a building can exert a significant aerodynamic force upon a scaffolding structure or window cleaning laborer, causing them to swing out and away from the building, and placing persons standing on that scaffolding or suspended on a rope in peril. Injuries from manual window washing operations are common, and have caused insurance rates to soar. Typically, the cost of insuring a window washing operation can reach 40% of the labor costs. Furthermore, the manual washing of building exteriors is slow and labor-intensive.

Effectively removing mineral deposits from building windows has been a problem which has long plagued the industry. Normal water supplies conventionally used for wash water contain some amount of dissolved solids, including calcium, magnesium, and sodium in the form of bicarbonates, carbonates, chlorides, or sulfates. Regardless of the type or form of the dissolved solids, when a water droplet is allowed to dry on a surface, the solids typically remain as deposits on the surface.

When washing a window, a single water drop left on the surface will typically contain between 300 and 1000 parts per million of dissolved solids, in addition to varying amounts of suspended solids removed from the surface by washing. When water drops evaporate, mineral deposits are left in "spots". Compounding the spotting problem is the fact that when a window is being cleaned in sunlight, the surface of the window can be elevated to as much as 120 degrees F. Wash water in such circumstances evaporates quickly and can be seen to "steam" off of the window. Heavy and ultimately damaging mineral deposits can result.

Surface active agents (i.e. cleaning agents), such as polyphosphate and organic detergents, serve to spread adhering water drops over a wider area, making water spotting less noticeable. However, the effect is only cosmetic as the accumulation of hard mineral deposits as a whole is unaffected.

Although various automatic window washing devices have been described in the art (see, for example, U.S. Pat. Nos. 3,344,454 and 3,298,052), the inventors are not aware of any such devices which have proven to be practical or accepted in use. Such devices typically employ mechanical techniques to scrub the surface and to remove residual water. These cleaners suffer from a combination of several problems. First, many require some form of tracking (e.g., vertical mullions) on the building facade to guide the device up and down and maintain cleaning contact with the surface. Second, many include elaborate mechanical water collection and liquid removal apparatus, adding weight and expense to the overall device. Finally, since it is difficult to completely remove all of the wash water from the surfaces, and since all devices known to the inventor use common tap water (with or without detergents) as the washing medium, they tend to clean ineffectively, leaving mineral deposits from the tap water itself.

It is desirable to use unmanned, self-propelled vehicles such as robots to perform a variety of functions that would be difficult or dangerous for a person to perform. For example many people frequently use robots to retrieve or dispose an explosive device or inspect or work in an environment that could kill or injure a person. People also frequently use robots to inspect or work in locations that typically are hard to access or are inaccessible by a person such as inspecting a pipeline.

Unfortunately, because robots typically propel themselves to a work site, use of most conventional unmanned, self-propelled vehicles is typically significantly limited by the ability of the robot to propel itself over a surface. For example, surfaces that include compound curves or three dimensional curves, abrupt inclinations or declinations, steps or gaps can cause conventional robots to become significantly less stable, i.e., more likely to lose their preferred orientation relative to the surface, as they traverse the surface or turn on it. In addition, surfaces that are slippery can cause conventional robots to easily lose a significant portion, if not all, of their traction to the surface. If either happens while traversing an incline or inverted surface such as a ceiling, such a loss of traction could cause the robot to fall. Such a fall could seriously damage the robot, its payload if it has any, or the surface or other components of the structure the robot is traversing.

Another problem with conventional robots is they tend to scrub the surface as they traverse and turn on it. This can cause undesirable scratches on the surface. For example, the exterior surface of the glass may have a reflective or solar coating or film that is more easily scratches than the glass.

Yet another problem with conventional robots is they tend to bounce or jerk as they propel themselves across a surface. This can be a significant problem during use on glass surfaces.

U.S. Pat. No. 5,249,326 discloses a washing system comprising a cleaning device for cleaning exterior surfaces of buildings, means for suspending the cleaning device in contact with the building surface to be cleaned, and means for causing the washing unit to traverse the building surface to be cleaned. Means for restraining the cleaning device against the building surface to be cleaned are provided, said restraining means including a restraining cable having a free weight attached thereto, means for attaching the restraining cable to the building at a point above the cleaning device, and a member for attaching the restraining cable to the building at a point below the cleaning device, the member being mounted on a suction cup adapted to engage the building. In use, the restraining cable is attached to the building at a point above the cleaning device, then passes over the cleaning device, and is threaded through the member below the cleaning device, such that the free weight hangs below the member and exerts a downward force on the cable, and the cable thereby restrains the cleaning device against the building surface to be cleaned. Preferably, the member connected to the suction cup comprises a pulley. Alternatively, it may be a loop, a U-shaped piece, or any other structure having a bore or passage through which the restraining cable can pass.

U.S. Pat. No. 4,465,446 discloses a cleaning machine for high-rise buildings having an elevator cage supporting a horizontal brush and a vertical brush. The brushes are mounted on arms which rotate 180 degrees to separately clean a window. A pair of suckers associated with hydraulic piston and cylinder assemblies space a brush adjacent the window. Another pair of hydraulic cylinders mounted on the case are connected to rollers that space a brush adjacent the window. There is no counterforce generator or device connected to the cage to continuously retain a brush in engagement with the window. A pair of cables connected to motor driven lift mechanisms operate to elevate the cage along the outer wall of the building.

U.S. Pat. No. 5,890,250 describes a robotic apparatus for applying fluids to the exterior surfaces of vertical, nearly vertical, or sloped surfaces with minimum human supervision. The robotic apparatus is designed to apply fluids to surfaces which may include obstacles such as window frames or gaps created by window seams, which the present invention is designed to traverse. The robotic apparatus includes housing, a drive assembly, a sliding vacuum assembly, a fluid spray assembly, and sensor and control systems. The drive assembly includes drive chains, cables, ropes or the like that are connected at one end to a carriage positioned on the top of the structure and to a stabilizing member or members at the other end.

U.S. Pat. No. 5,707,455 describes an automated cleaning method is provided for an exterior wall of a building. Elongated, water-tight or electrically-insulating hollow members are accommodated within upper and lower sash rails constructing said exterior wall so that said hollow members continuously extend in horizontal directions, respectively. An electrical conductor extends in one of the hollow members. The other hollow member forms a drainage system. A cleaning apparatus main unit is arranged so that said cleaning apparatus main unit is supplied with electric power through said conductor to permit self-traveling in a horizontal direction along said exterior wall and is also supplied with washing water from said drainage system to permit cleaning of a surface of said exterior wall. The washing water is drained into said drainage subsequent to the cleaning by said cleaning apparatus main unit. The washing water can be recirculated for reuse.

U.S. Pat. No. 5,014,803 describes a device, including a window cleaning device, comprising a main body, a motor and drive wheels mounted on the main body, a partitioning member mounted on the main body and defining a pressure reduction space in cooperation with the main body and a wall surface, and a vacuum pump for reducing the pressure of the pressure reduction space. The device can suction-adhere to the wall surface by the pressure of an ambient fluid acting on the main body owing to the difference in fluid pressure between the inside and outside of the pressure reduction space and move along the wall surface by the action of the moving member. The partitioning member has an outside wall portion extending from its one end to a contacting portion contacting the wall surface and an inside wall portion extending from the contacting portion to its other end. A stretchable and contractible portion is provided in at least one of the outside and inside wall portions, and the contacting portion moves toward and away from the wall surface by the stretching and contracting of the stretchable and contractible portion.

U.S. Pat. No. 6,550,090 discloses a machine for cleaning high rise buildings with motor driven rotating brushes mounted within a case. A pair of plates secured to the top and bottom of the case ride on the outer surface of the building during movement of the machine relative to the building. The machine is hung with a cable from the top of the building. The cable is pulled and shifted to move the machine vertically and horizontally along the outer surface of the building. A motor driven propeller mounted on the back of the case provides a pushing force to the case to retain the plates in engagement with the outer surface of the building during cleaning of the outer surface of the building with the rotating brushes.

U.S. Patent Application Publication US 2003/0106176 discloses an automatic washing system for tall buildings having a winding device at the top of the building connected to a cable secured to a washing device located adjacent the outside surface of a building. The washing device has a pair of brushes that are rotated with an electric motor to clean the outside of the building. A plurality of fans located at the rear side of the washing device discharges air in a direction that is opposite the outside surface of the building so that negative air pressure generated relative to the washing device presses the brushes against the outside surface of the building during the cleaning of the outside surface of the building.

U.S. Patent Application Publication US 2009/0100618 discloses a cleaning apparatus for the exterior walls of buildings. The cleaning apparatus has a housing rotatably supporting a pair of cleaning brushes and a motor operable to rotate the brushes. A set of external hoisting hangers support the cleaning apparatus adjacent the exterior wall of a building. A gas producer mounted on the housing discharges an airflow which presses the brushes against the exterior wall of the building during cleaning of the exterior wall of the building.

SUMMARY OF THE INVENTION

A cleaning apparatus and method for use to clean upright surfaces without the use of personnel at the specific site of cleaning. The cleaning apparatus has a frame supporting at least one rotatable cleaning element. The cleaning element is a rotatable scrubbing member or brush having flexible vanes that engage a surface to clean foreign materials from the surface. A pair of cleaning elements can be mounted on the frame. A winch mounted on the frame is operably connected to a cable that pendently supports the cleaning apparatus from a davit mounted above the surface, such as the exterior sidewall of a building. An electric motor mounted on the frame operates the winch to move the cleaning apparatus up and down the surface during the cleaning of the surface. A shield mounted on the frame separates the cleaning element from the winch and motor to confine air and cleaning liquid to the area accommodating the cleaning element. A liquid application mounted on the frame or shield is configured to spray a cleaning liquid on the surface during cleaning of the surface with the cleaning element. A counterforce generator mounted on the frame provides a substantially horizontal perpendicular continuous force or thrust on the frame and cleaning element towards the surface to maintain the cleaning element in effective continuous engagement with the surface during movement of the cleaning apparatus relative to the surface. The counterforce generator includes an air mover, such as a motor driven fan or blower. There is constant pressure on the cleaning element to retain the cleaning element in continuous engagement with the surface being cleaned. This prevents separation of the cleaning element from the surface due to wind, air currents and window frames.

DETAILED DESCRIPTION OF THE INVENTION

Figure 1:
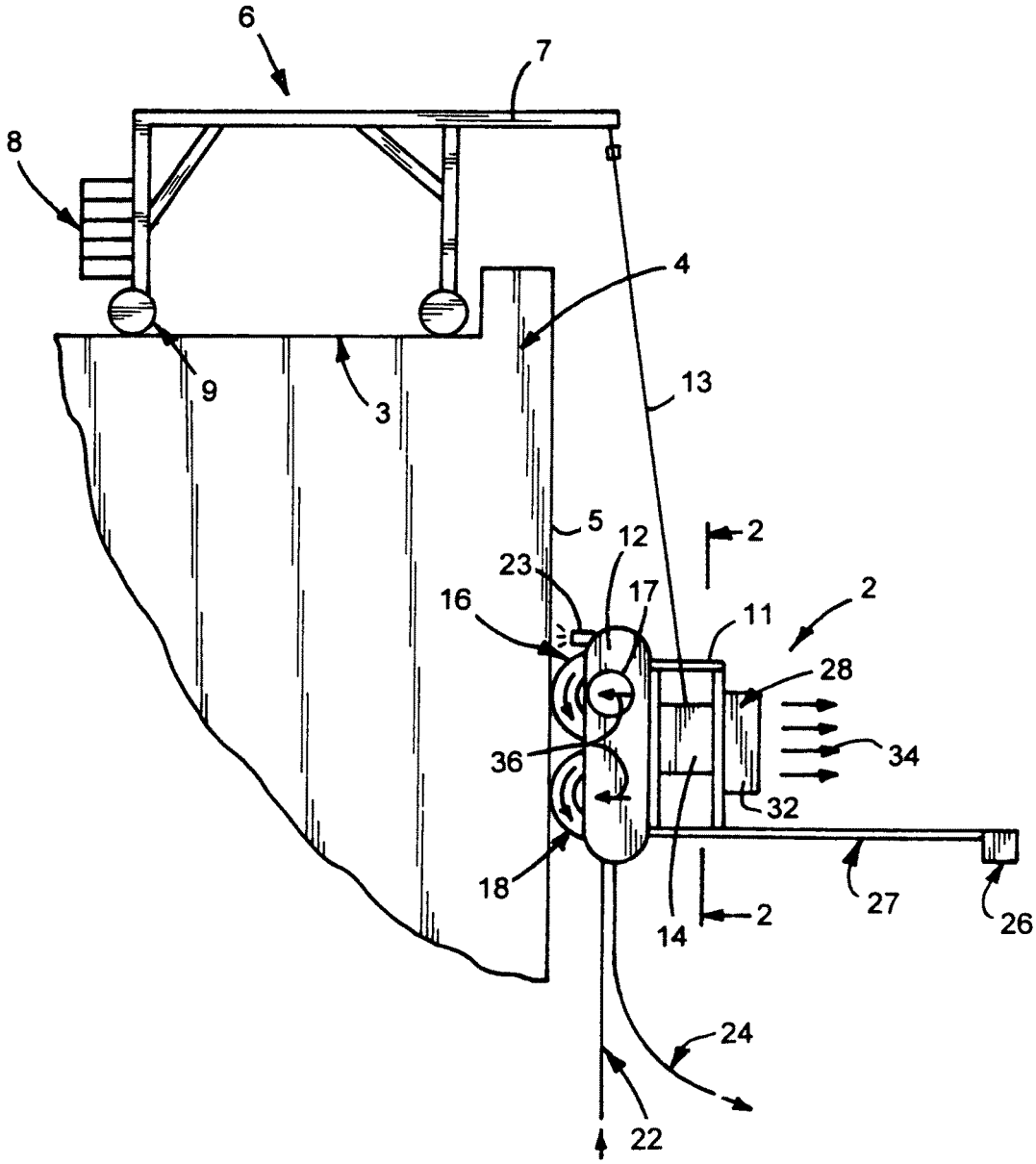
FIG. 1 is a schematic side elevational view of a first embodiment of the cleaning apparatus of the invention pendently supported adjacent the outside wall of a building.

A cleaning apparatus and method according to technology described herein has at least two distinct components that interact to provide a complete cleaning system for the cleaning of surfaces, such as the exterior vertical wall and windows of office buildings, hotels, hospitals and other multistory structures with, by way of non-limiting examples, up to 8 or 10 inches of sharp vertical deviation from flatness between areas of the surfaces (e.g., vertical elevation of panels separating window areas). The apparatus exhibits stability against winds and provides high quality cleaning ability on window surfaces without the use of personnel at the immediate cleaning areas.

A non-limiting general description of the cleaning apparatus described herein may be considered as a washing system for elevated surfaces comprising: a) a housing having a liquid application cleaning system therein; b) a support element that supports and elevates the washing system; c) a rigid member extending from a surface of the housing that faces away from a surface to be cleaned so that the cable, when supporting the cleaning system against the surface to be cleaned and connected to the housing at a connection point, exerts a rotational force on the cleaning system in respect to the fulcrum point at the roof davit connection point; d) weights provided at a distance and direction from the connection point to at least in part counterbalance the rotational force around the connection point on the extended member. The cleaning apparatus may have the support element comprises a) a cable, b) hose, c) rope, or d) two or more of a rope, cable and hose connected to a davit mounted on top of a building. The cleaning apparatus may include a weight located on a rigid frame. The cleaning system may comprise at least one brush that contacts the surface to be cleaned, or at least two brushes that contact the surface to be cleaned. A counterforce generator mounted on the frame establishes a continuous force or thrust that retains the cleaning in effective engagement with the surface during cleaning thereof.

The cleaning apparatus for the surfaces is generally designed for glass or coated glass (e.g., surfaces having abrasion-resistant coatings, light filtering coatings, enhanced cleanable surfaces, etc.) surfaces, but any structure having a relatively flat surface can be cleaned by the present technology. The actual cleaning is done by the application of a cleaning liquid to the surface with sufficient forces involved in the time frame immediate with the liquid application or subsequent to the application to assist in removal of dirt, film, particles, soil age, salt, caked material, deposits, and the like from the surface. Although many systems use jet spray or hand application, especially in conjunction with personnel at the cleaning site (e.g., handling applicators, squeegees, brushes, hoses, buckets, sprays, etc., as opposed to merely being on the roof directing the equipment), jet spray application is less preferred because of its tendency under Newton's Second Law of Motion to push the cleaning apparatus from the wall and make it more susceptible to displacement by ambient air currents and wind. Jet spray application, even with the assistance of heat and chemical, fails to clean the film coating on the surface being cleaned. A preferred application cleaning apparatus comprises brush application, sponge application, strip application, foam finger application, sheet application and the like, where physical elements exert a physical force such as a rubbing action against the surface to be cleaned in the present of a cleaning liquid (which may be water, alone). The second component therefore usually may comprise a frame for support of a motor, liquid delivery system, physical contact system for applying force against the surface to be cleaned while the surface is in contact with the liquid, and a counterforce generator that assist in keeping the physical contact system in a cleaning orientation with respect to the surface to be cleaned. Each of these elements will be discussed in greater detail in a review of the Figures of the described technology.

Figure 2:
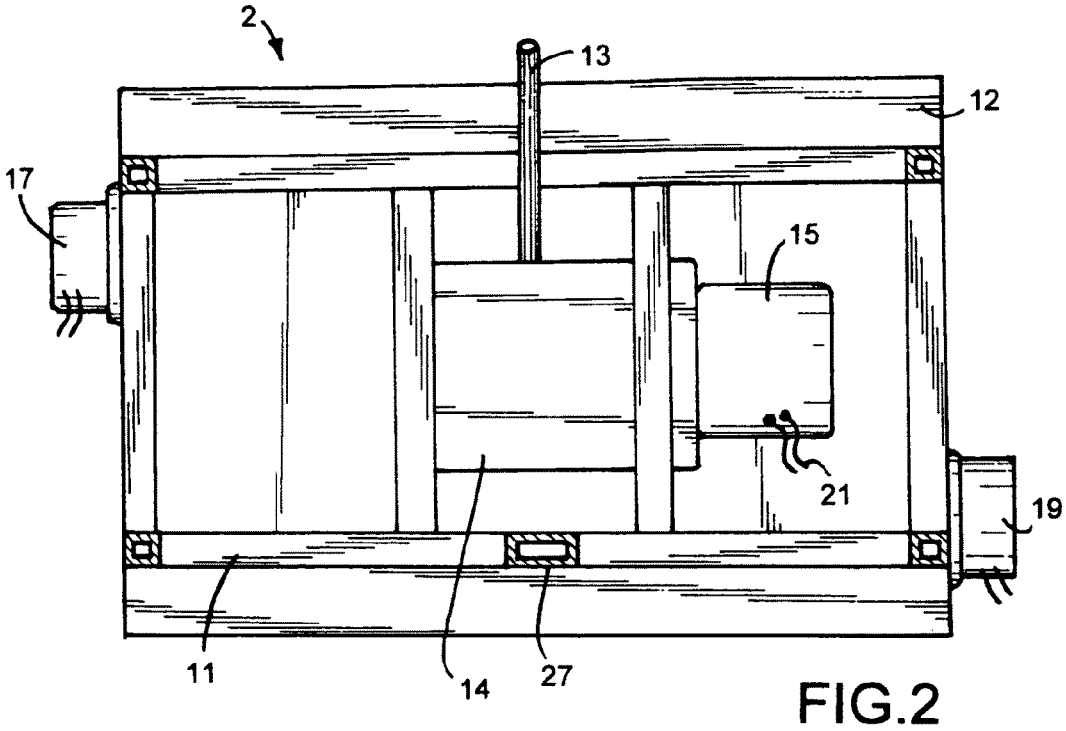
FIG. 2 is an enlarged sectional view taken along line 2-2 of FIG. 1.
Figure 3:
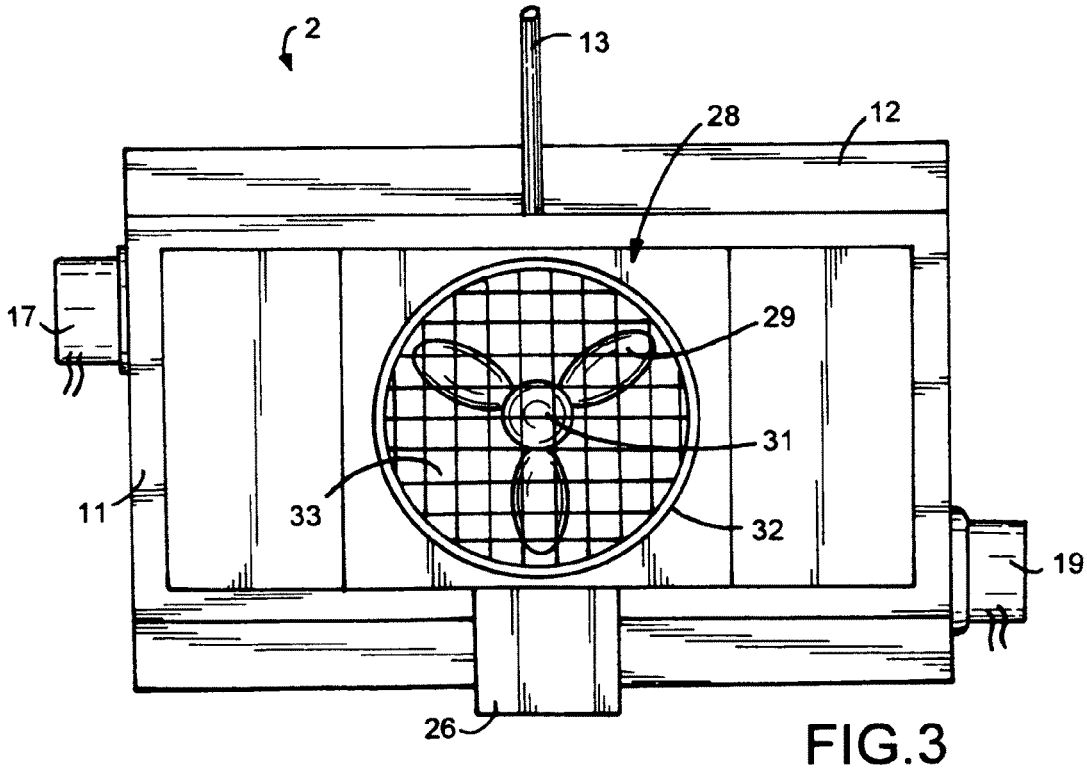
FIG. 3 is an enlarged side elevational view of the right side of FIG. 1.

A first embodiment of the cleaning apparatus 2, shown in FIGS. 1 to 3, pendently supported adjacent the outside of a building 4 is operable to cleaning the outside wall or windows 5. A support or davit 6 located on the building's roof 3 has a generally horizontal arm 7 extended outwardly from the top of building 4. A plurality of counterweights 8 mounted on the inner end of davit 6 maintain arm 7 in a generally horizontal position and counter the weight of cleaning apparatus 2 connected thereto with a cable 13. The upper end of cable 13 is secured to the outer end of arm 7. Davit 6 has wheels 9 that permit movement of davit 6 along roof 3 during cleaning of wall 5. Other types of davits can be used to pendently support cleaning apparatus adjacent the side of a building or an upright structure.

Cleaning apparatus 2 has a frame 11 having horizontal and vertical interconnected members or beams. A housing or shield 12 is secured to frame 11. Shield 12 has a back wall and side walls with an opening facing the outside wall 5 of building 4. A grip style winch 14 drivably connected to an electric motor 15 is mounted on frame 11. Cable 13 is operatively connected to winch 14 whereby winch 14 operated by motor 15 winds and unwinds cable 13 to selectively move cleaning apparatus 2 up and down relative to wall 5 of building 4. An elongated chain, web or strap can be used to pendently support cleaning apparatus 2 from davit 6. An electric cable 21, shown in FIG. 2, extends to ground and a source of electric power. A manual control connected to cable 21 is used to control the operation of motor 15. A remote control unit can alternatively be used to control the operation of motor 15.

A pair of generally horizontal cleaning members or brushes 16 and 18 are rotatably mounted within housing 12. Circumferential portions of each brush 16 and 18 extend outwardly from housing 12 to allow brushes 16 and 18 to engage wall 5 and clean wall 5. As shown in FIGS. 2 and 3, electric motors 17 and 19 drivably connected to brushes 16 and 18 rotate brushes 16 and 18 in opposite directions during cleaning of wall 5. Motors 17 and 19 are connected with electric cables to a source of electric power. Manual controls joined to the cables are used to control the operation of motors 17 and 19.

A hose 22 connected to housing 12 delivers cleaning liquid, such as water, to liquid dispensers 23 mounted on housing 12. Cleaning liquid is sprayed onto wall 5 above brush 16 whereby brush 16 scrubs the wet surface of wall 5. Hose 22 is attached to a liquid supply system, such as a pump and deionized water tank (not shown). A plurality of liquid applicators can be associated with housing 12 to dispense cleaning liquid onto wall 5. Excess liquid is drained from the bottom of housing 12 with a drain hose 24.

Cleaning apparatus 2 is counterbalanced with a counterbalancing weight 26 mounted on the outer end of a rod or pole 27. Pole 27 is secured to frame 11 and extends outwardly horizontally from frame 11. The counterbalancing weight 26 provides a downward pivotal force that balances the weight of cleaning apparatus 2 and maintains an inward force on brushes 16 and 18 and stabilizes the cleaning apparatus.

A counterforce generator 28 mounted on frame 11 establishes a counterforce or thrust that continuously maintains brushes 16 and 18 in effective cleaning engagement with wall 5. As shown in FIG. 3, force generator 28 comprises a rotatable fan 29 driven with an electric motor 31. Fan 29 is positioned within a cylindrical shroud 32 mounted on frame 11 outwardly of winch 14. A screen shield 33 secured to shroud 32 is located over the air outlet of shroud 32. Fan 29 when rotated by motor 31 discharges air, shown by arrows 34 in FIG. 1, in an outwardly lateral direction. The moving air establishes a continuous counterforce or thrust on generator 28, frame 11, housing 12 and brushes 16 and 18, as shown by arrows 36, that maintains brushes 16 and 18 in continuous effective cleaning engagement with wall 5 during movement of cleaning element relative to wall 5. Generator 28 is mounted on frame 11 in a location to apply substantially equal counterforce on brushes 16 and 18 to maintain both brushes 16 and 18 in cleaning engagement with wall 5. Counterforce generator 28 can be a plurality of motor driven fans mounted on frame 11. Blowers, air pumps and air and gas movers can be used as a counterforce generator to provide a substantially perpendicular continuous force on cleaning brushes toward wall 5 to maintain the brushes in continuous effective contact with wall 5 during cleaning of wall 5. This presents separation of brushes 16 and 18 from wall 5 due to wind, air currents, mullions, window frames and other building structures. The counterforce also reduces vertical and horizontal swinging movements of cleaning apparatus 2.

Counterforce generator 28 can be provided with one or more movable air outlets, vanes, rudders or nozzles to direct air in selected lateral, horizontal, and vertical directions to adjust the direction of the counterforce on brushes 16 and 18 to maintain brushes 16 and 18 in effective continuous cleaning engagement with wall 5.

The method for cleaning the exterior surface of wall 5 including windows thereon is characterized by providing cleaning apparatus 2 and locating cleaning apparatus 2 with brushes 16 and 18 facing wall 5. The cleaning apparatus 2 is pendently supported adjacent wall 5 with cable 13 attached to davit 6 supported on top of building 4. Brushes 16 and 18 are rotated in opposite directions with motors 17 and 19. The cleaning apparatus operator with a control unit regulates the speed and ON and OFF conditions of motors 17 and 19 A cleaning liquid is dispensed from one or more applicators 23 onto wall 5 adjacent brush 16 during cleaning of wall 5. The cleaning apparatus 2 is moved up and down relative to wall with winch 14 operated by motor 15. The cleaning apparatus operator with a control unit controls the speed, direction of operation and ON and OFF operation of motor 15. A counterforce established with force generator 28 biases brushes 16 and 18 continuously in a generally horizontal direction perpendicular to the outer surface of wall 5 during cleaning of wall 5 as cleaning apparatus 2 is moved relative to wall 5. The counterforce maintains brushes 16 and 18 in surface engagement with wall 5.

Figure 4:
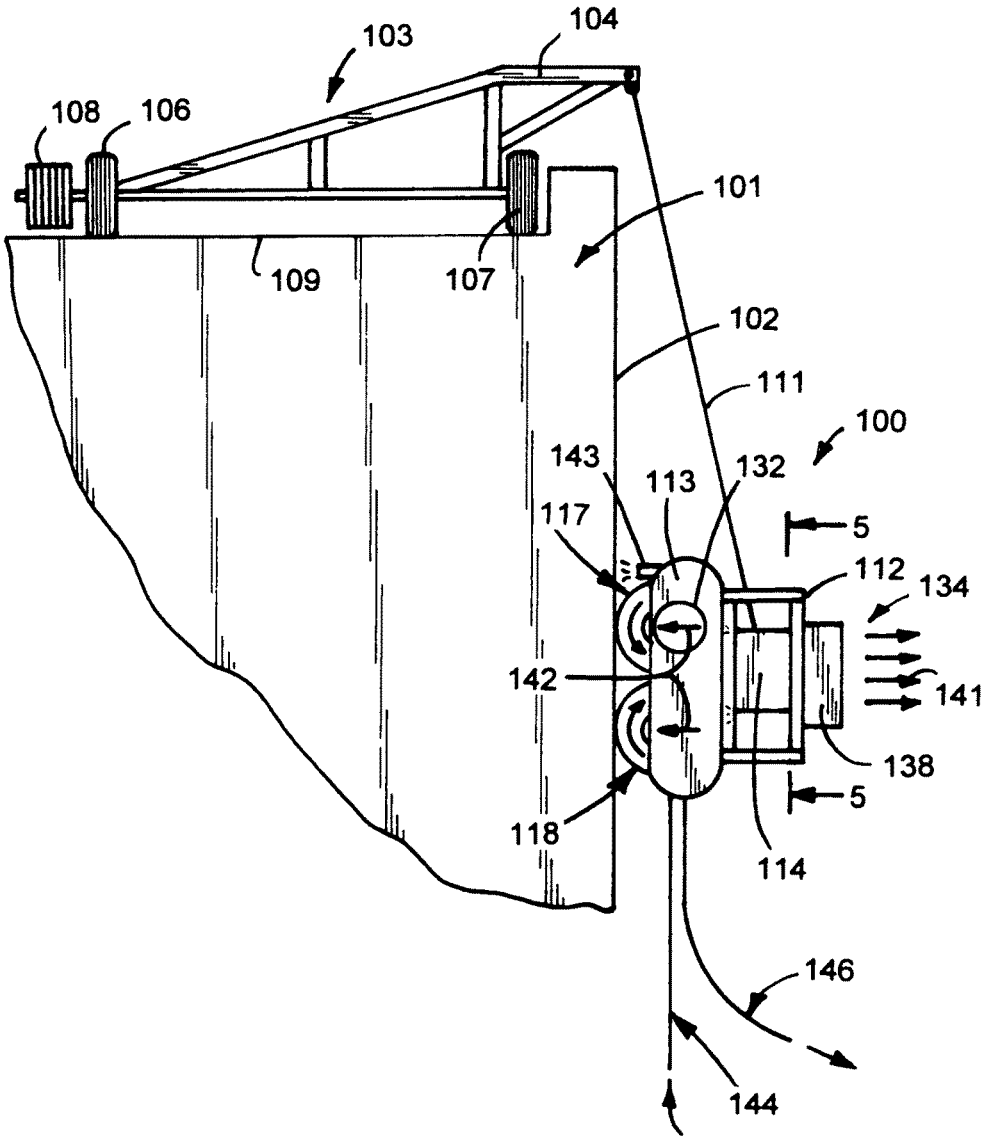
FIG. 4 is a schematic side elevational view of a second embodiment of the cleaning apparatus of the invention pendently supported adjacent the outside of a building.
Figure 5:
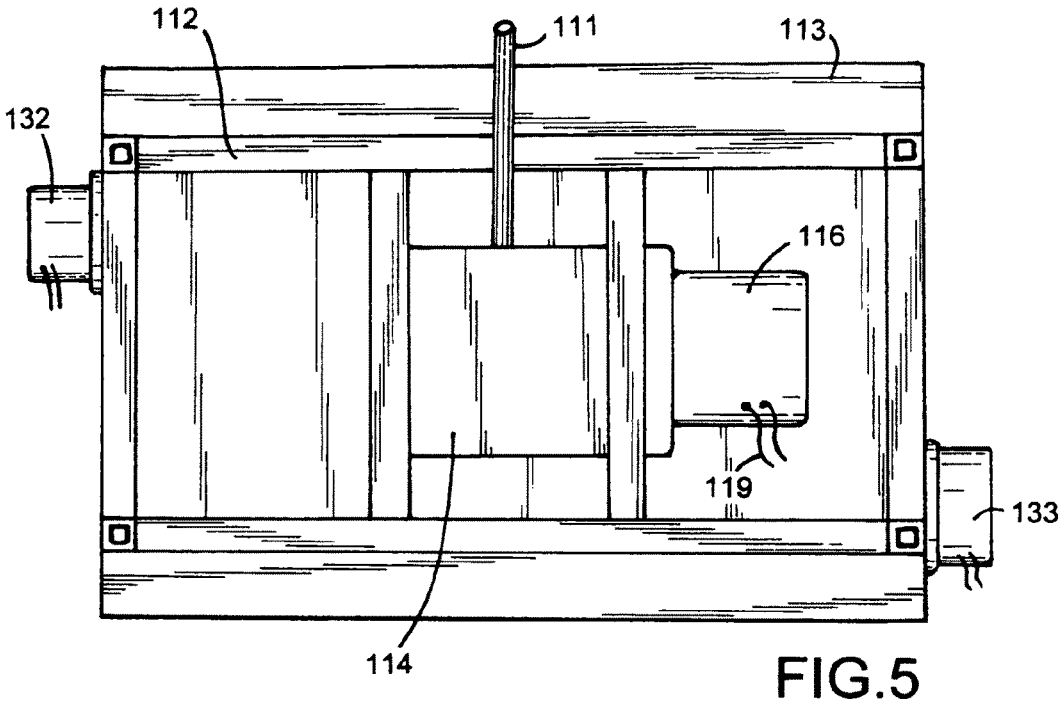
FIG. 5 is an enlarged sectional view taken along line 5-5 of FIG. 4.
Figure 6:
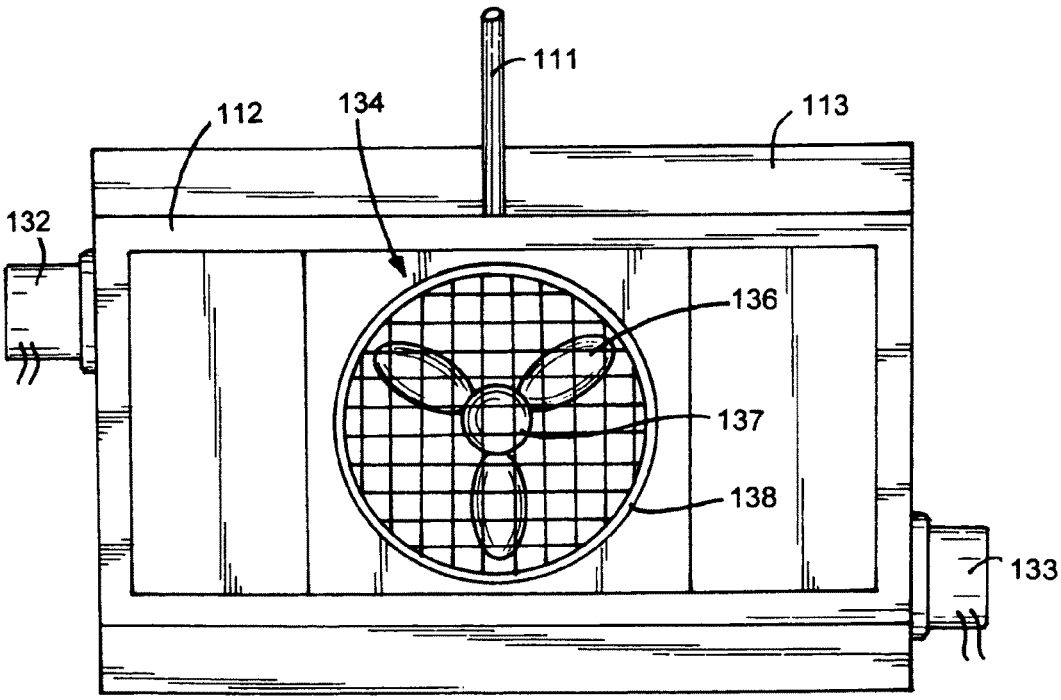
FIG. 6 is an enlarged side elevational view of the right side of FIG. 4.

The second embodiment of the cleaning apparatus 100, shown in FIGS. 4 to 6, pendently supported adjacent the outside of a building 202 is operable to cleaning the outside wall or windows 203. A support or davit 103 located on the building's roof 109 has a generally horizontal arm 104 extended outwardly from the top of building 101. A plurality of counterweights 108 mounted on the inner end of davit 193 maintain arm 104 in a generally horizontal position and counter the weight of cleaning apparatus 100 connected thereto with a cable 111. The upper end of cable 111 is secured to the outer end of arm 104. Davit 103 has wheels 106 and 107 that permit movement of davit 103 along roof 109 during cleaning of wall 102. Other types of davits can be used to pendently support cleaning apparatus adjacent the side of a building or an upright structure.

Cleaning apparatus 100 has a frame 112 having horizontal and vertical interconnected members or beams. A housing or shield 113 is secured to frame 112. Shield 113 has a back wall and side walls with an opening facing the outside wall 102 of building 101. A grip style winch 114 drivably, connected to an electric motor 116 is mounted on frame 112. Cable 111 is operatively connected to winch 114 whereby winch 114 operated by motor 116 winds and unwinds cable 111 to selectively move cleaning apparatus 100 up and down relative to wall 102 of building 101. An elongated chain, web or strap can be used to pendently support cleaning apparatus 100 from davit 103. An electric cable 119, shown in FIG. 5, extends to ground and a source of electric power. A manual control connected to cable 119 is used to control the operation of motor 114. A remote control unit can alternatively be used to control the operation of motor 116.

A pair of generally horizontal cleaning members or brushes 117 and 118 are rotatably mounted within housing 113. Circumferential portions of each brush 117 and 118 extend outwardly from housing 113 to allow brushes 117 and 118 to engage wall 102 and clean wall 102. As shown in FIGS. 5 and 6, electric motors 132 and 133 are drivably connected to brushes 117 and 118 rotate brushes 117 and 118 in opposite directions during cleaning of wall 102. Motors 132 and 133 are connected with electric cables to a source of electric power. Manual controls joined to the cables are used to control the operation of motors 132 and 133.

Figure 7:
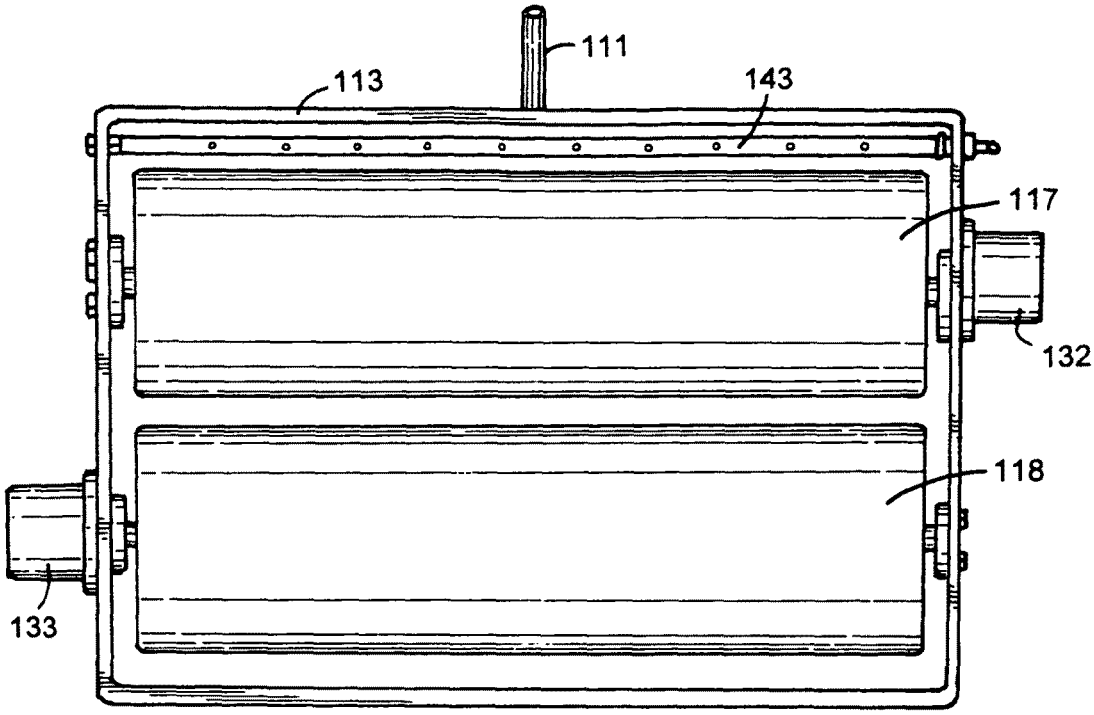
FIG. 7 is an enlarged side elevational view of the left side of FIG. 4.

A hose 144 connected to housing 113 delivers cleaning liquid, such as water, to liquid dispensers 143 mounted on housing 113. Cleaning liquid is sprayed onto wall 102 above brush 117 whereby brush 117 scrubs the wet surface of wall 102. Hose 144 is attached to a liquid supply system, such as a pump and deionized water tank (not shown). A plurality of liquid applicators shown in FIG. 7 are associated with housing 143 to dispense cleaning liquid onto wall 102. Excess liquid is drained from the bottom of housing 113 with a drain hose 146.

Figure 8:
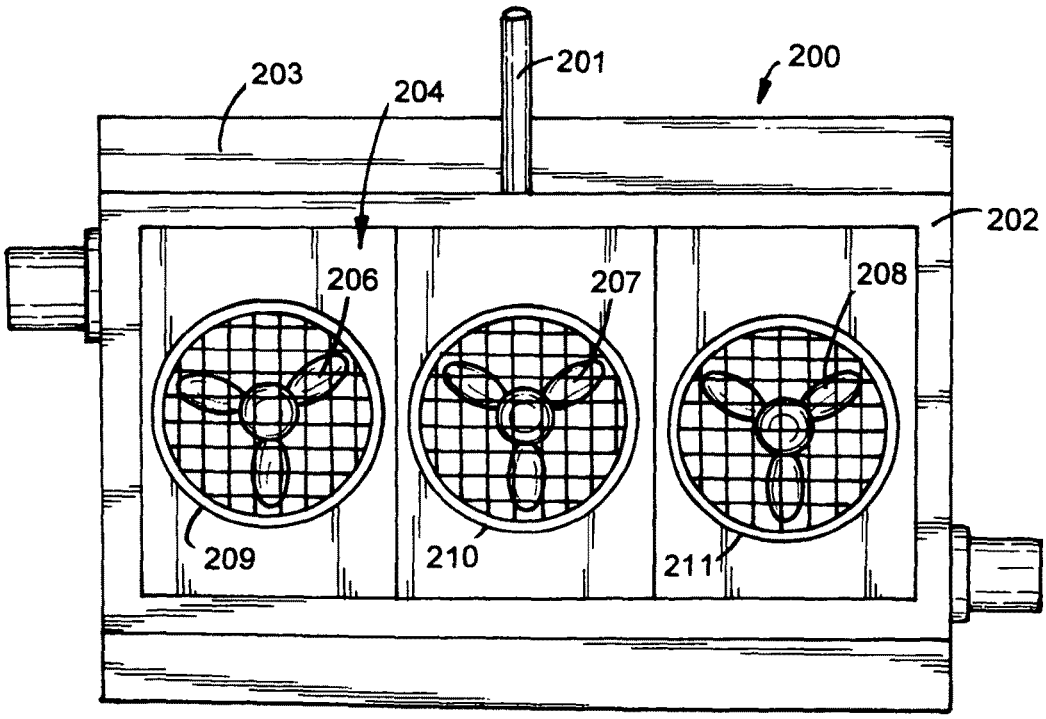
FIG. 8 is a perspective view of a cleaning brush showing the support body and cleaning vanes attached thereto.
Figure 9:
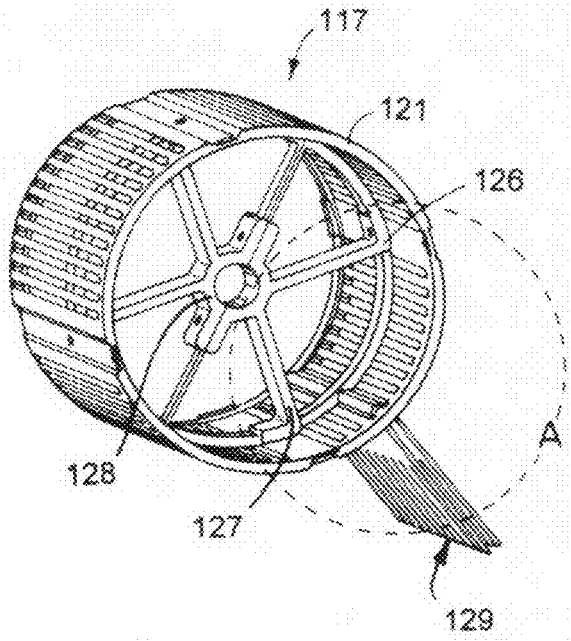
FIG. 9 is an enlarged cutaway perspective view of section A of FIG. 8.

A section of brush 117, shown in FIGS. 8 and 9, has a support body comprising a cylindrical rim 121 having adjacent transverse slots 122 and 123 separated with transverse bars 124. A plurality of radial spokes 126 and 127 secure rim 121 to a cylindrical clamp or sleeve 128 attached to the axial shaft of brush 117. A plurality of flexible plastic vanes or brush members 129 mounted rim 121 extend radially outward from rim 121. A single strip of vane material forms two vanes by looping 131 the material through adjacent openings in rim 121. This facilitates removal and replacement of vanes from rim 121. An arcuate retainer 131 fastened to spokes 126 and 127 holds vanes 129 in assembles relation with rim 121. A plurality of rims are attached end to end to provide a complete brush. Brushes 16, 18, and 118 has the same structure as brush 117.

A counterforce generator 134 mounted on frame 112 establishes a counterforce or counter thrust that continuously maintains brushes 117 and 118 in effective cleaning engagement with wall 102. As shown in FIG. 6, force generator 134 comprises a rotatable fan 136 driven with an electric motor 137. Fan 136 is positioned within a cylindrical shroud 138 mounted on frame 112 outwardly of winch 114. A screen shield 139 secured to shroud 138 is located over the air outlet of shroud 138. Fan 136 when rotated by motor 137 discharges air, shown by arrows 141 in FIG. 4, in an outwardly lateral direction. The moving air establishes a continuous counterforce on generator 134, frame 112, housing 113 and brushes 117 and 118, as shown by arrows 142, that maintains brushes 117 and 118 in effective cleaning engagement with wall 102 during movement of cleaning elements relative to wall 102. Generator 134 is mounted on frame 112 in a location to apply substantially equal counterforce on brushes 117 and 118 to maintain both brushes 117 and 118 in cleaning engagement with wall 102. Counterforce generator 134 can be a plurality of motor driven fans mounted on frame 112. Blowers, air pumps and air and gas movers can be used as a counterforce generator to provide a substantially perpendicular continuous force on the cleaning brushes toward wall 102 to maintain the brushes in continuous contact with wall 102 during cleaning thereof. This prevents separation of brushes 117 and 118 from wall 102 due to wind, air currents, mullions, window frames and other building structures. The counterforce also reduces vertical and horizontal swinging movements of cleaning apparatus 100. Counterforce generator 134 can be provided with one or more movable air outlets, vanes, rudders or nozzles to direct air in selected lateral, horizontal, and vertical directions to adjust the direction of the counterforce on brushes 117 and 118 to maintain brushes 117 and 118 in effective continuous cleaning engagement with wall 102.

Figure 10:
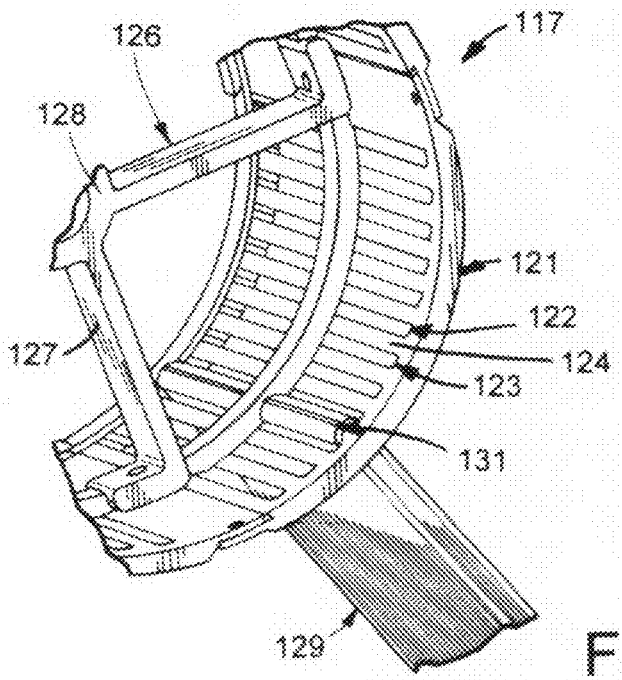
FIG. 10 is an enlarged side elevational view of the right side of a modification of the cleaning apparatus.

A modification of the cleaning apparatus 100 is shown in FIG. 10. Cleaning apparatus 200 is attached to a cable 201 that pendently supports cleaning apparatus 200 adjacent an upright wall or window of a structure for cleaning thereof. Cleaning apparatus 200 has a frame 202 supporting a housing or shield 203 accommodating one or more rotatable brushes or cleaning elements. A counterforce generator 204 mounted on frame 202 generates a counterforce that continuously maintains the cleaning brushes in continuous effective cleaning engagement with the wall or window during cleaning thereof. Generator 204 has a plurality of motor driven fans 206, 207 and 208 surrounded with cylindrical shrouds 209, 210 and 211. The counterforce created by rotation of fans 206, 207 and 208 biases the cleaning brushes continuously in a generally horizontal direction perpendicular to the surface during cleaning of the surface as the cleaning apparatus 200 is moved relative to the surface of the structure.

A third embodiment of the cleaning apparatus 300, shown in FIGS. 11 to 14, is pendently supported with a cable 306 from a davit located on a building. Cleaning apparatus 300 has a frame 301 comprising horizontal frame members 302 and 303 connected to upright frame members 304 and 305. An arcuate shield 307 secured to frame member 302 is located adjacent an inside circumferential portion of a cleaning element or brush 308. Brush 308 has a plurality of outwardly extended vanes 309 mounted on a cylindrical body 311. The structure of brush 117 shown in FIGS. 8 and 9 is the same as brush 308. Brush 308 is rotatably mounted for rotation about a horizontal axis on bearings 312 and 313 secured to upright members 304 and 305. An electric motor 314 drives a power transmission or gear box 316 operatively connected to brush 308 whereby on operation of motor 314 brush is rotated.

A liquid applicator 317 mounted on frame member 302 above brush 308 operates to dispense cleaning liquid onto the surface to be cleaned. Applicator 317 includes an elongated tube 318 supporting a plurality of nozzles 319 operable to spray liquid, such as deionized water, to the surface to be cleaned with brush 308. Application 317 is connected to a source of liquid under pressure, such as a pump. A second liquid applicator 321 is mounted on bottom frame member 303.

The cleaning apparatus 300 is moved up and down relative to an upright surface of a structure with a grip style winch 322 connected to cable 306. A DC electric motor 323 coupled to winch 322 operates winch 322 to selectively wind and unwind cable 306 to move cleaning apparatus 300 along the surface during cleaning of the surface. Other types of winches and cable pulling devices can be used with cable 306, a chain or strap to move cleaning apparatus 300. Winch 322 and motor 323 are mounted on frame members 324 whereby the motor driven winch 322 on frame 301 is operable to move cleaning apparatus 300 relative to a surface during cleaning of the surface. Motor 323 is coupled to a source of electric power with an electric cord and a manually operated control unit to regulate the speed, direction of operation and ON and OFF conditions of motor 323. A remote control can be used to regulate the operation of motor 323.

Figure 11:
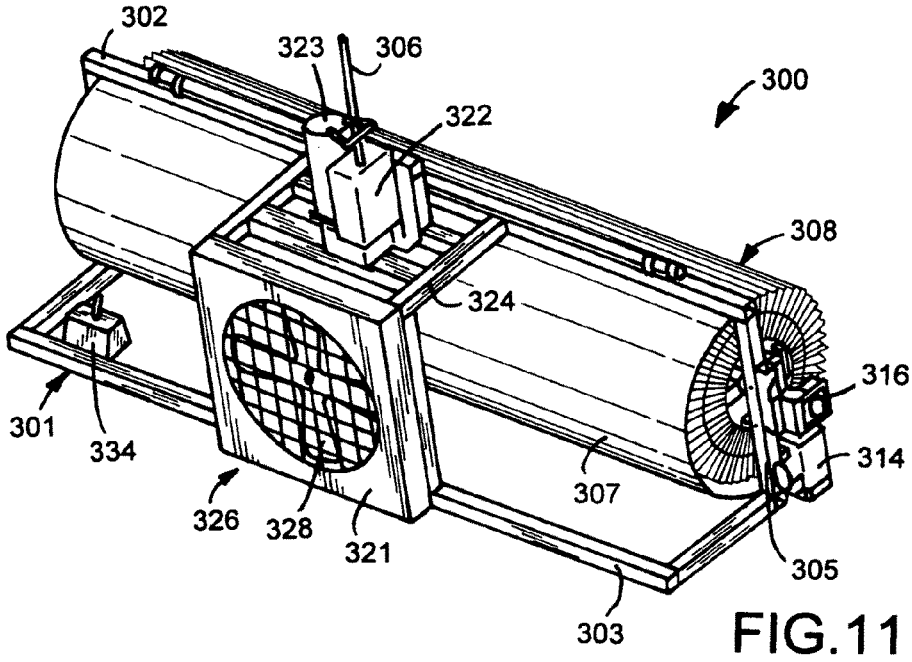
FIG. 11 is a perspective view of a third embodiment of the cleaning apparatus of the invention.
Figure 12:
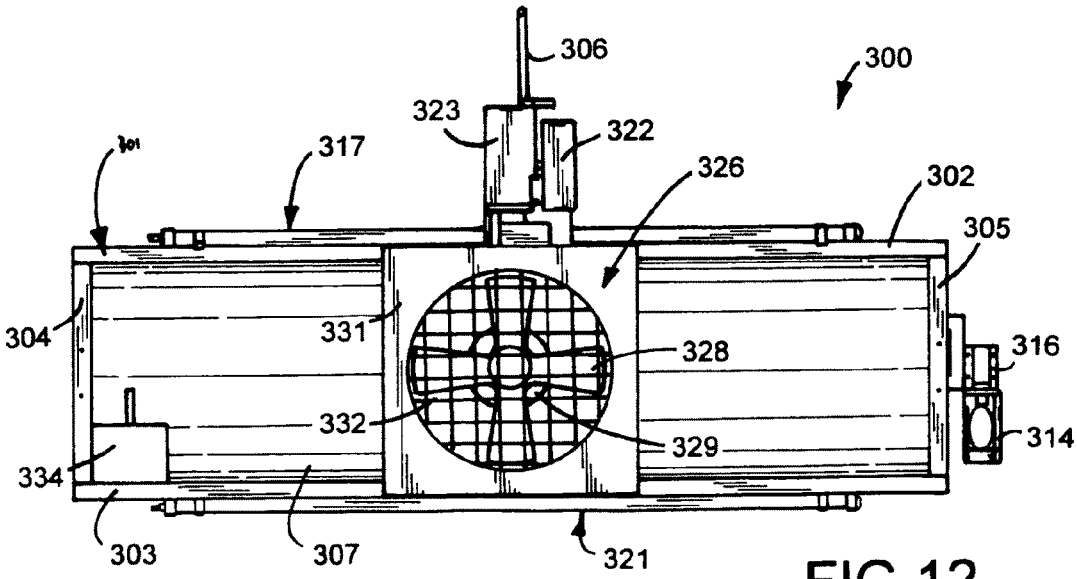
FIG. 12 is a front elevational view of the cleaning apparatus of FIG. 11.
Figure 13:
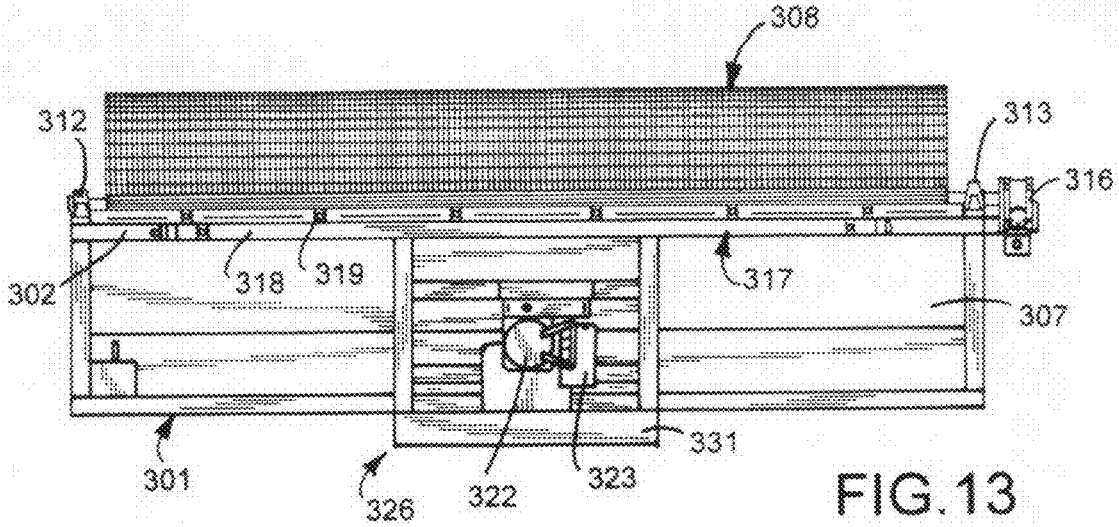
FIG. 13 is a top plan view of the cleaning apparatus of FIG. 11.
Figure 14:
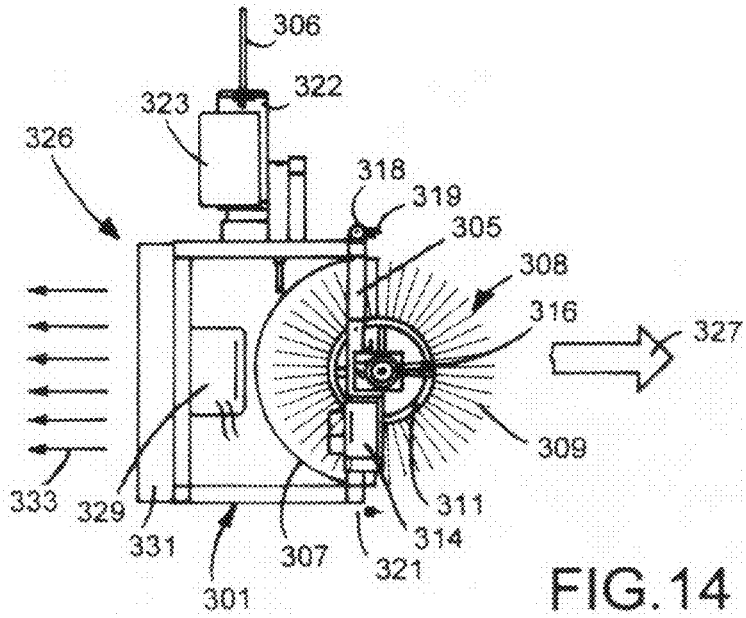
FIG. 14 is a side elevational view of the right side of FIG. 11.

A counterforce generator 326 mounted on frame members 303 and 324 generates a counterforce or counter thrust, shown in FIG. 14 by arrow 327 that continuously maintains brush 308 in effective cleaning engagement with the surface being cleaned. As shown in FIGS. 11 and 12, force generator 326 comprises a rotatable fan 328 driven with an electric motor 329. Fan 328 is positioned within a cylindrical shroud 331 mounted on frame 301. A screen 332 attached to shroud 331 is located over the air outlet of shroud 331. Fan 328 when rotated by motor 329 dispenses air outwardly from cleaning apparatus 300 as shown by arrows 333 in FIG. 14. The air moved by fan 328, shown by arrows 333, establishes a continuous counterforce, shown by arrow 327 opposite the direction of movement of the air discharged by fan 328 on brush 308. This counterforce is generally horizontal and perpendicular to the surface being cleaned with brush 308. The counterforce is a counter thrust that maintains brush 308 in continuous effective cleaning engagement with the surface being cleaned during movement of cleaning apparatus 300 along the surface being cleaned. The axis of rotation of fan 328 is located in substantially the same horizontal plane as the axis of rotation of brush 308 whereby the counterforce does not alter the perpendicular cleaning engagement of brush 308 relative to the surface being cleaned. Counterforce generator 326 can include a plurality of motor driven fans mounted on frame 301 as shown by generator 204 in FIG. 10. A remote wireless signal receiver 334 mounted on frame 301 is part of a wireless remote control system used by the operator of cleaning apparatus 300 to control the operation of motors 314 and 329. The operator can change the speed and direction of rotation of winch motor 314 to alter the rate and direction of movement of cleaning apparatus 300. The operator can also change the speed of operation of motor 329 to regulate the counterforce established by counterforce generator 326.

Blowers, air pumps, and air and gas movers can be used as a counterforce generator to provide a substantially perpendicular continuous force on a cleaning brush to maintain the brush in continuous effective contact with the surface being cleaned. This prevents separation of the brush 308 from the surface being cleaned due to wind, air currents, mullions, window frames and other building structures.

Counterforce generator 326 can be provided with one or more movable air outlets, vanes, rudders or nozzles to direct air in selected lateral, horizontal and vertical directions to adjust the direction of the counterforce on brush 308 to maintain the brush 308 in an effective continuous cleaning engagement with the surface being cleaned. Generator 326 can be mounted on frame 301 in adjustable horizontal and vertical locations with adjustable brackets.

Figure 15:
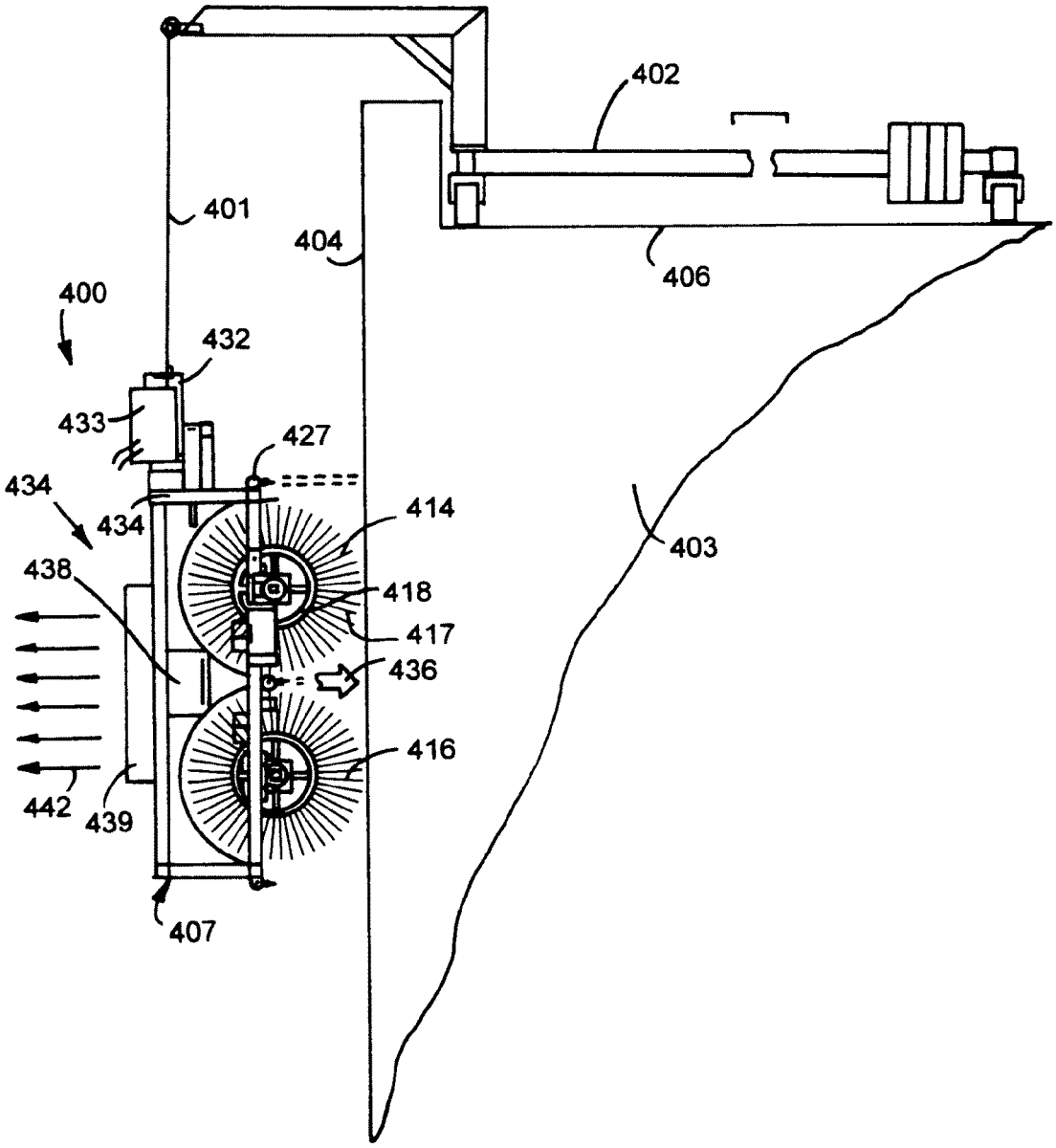
FIG. 15 is a side elevational view of a fourth embodiment of the cleaning apparatus of the invention pendently supported on a building.
Figure 16:
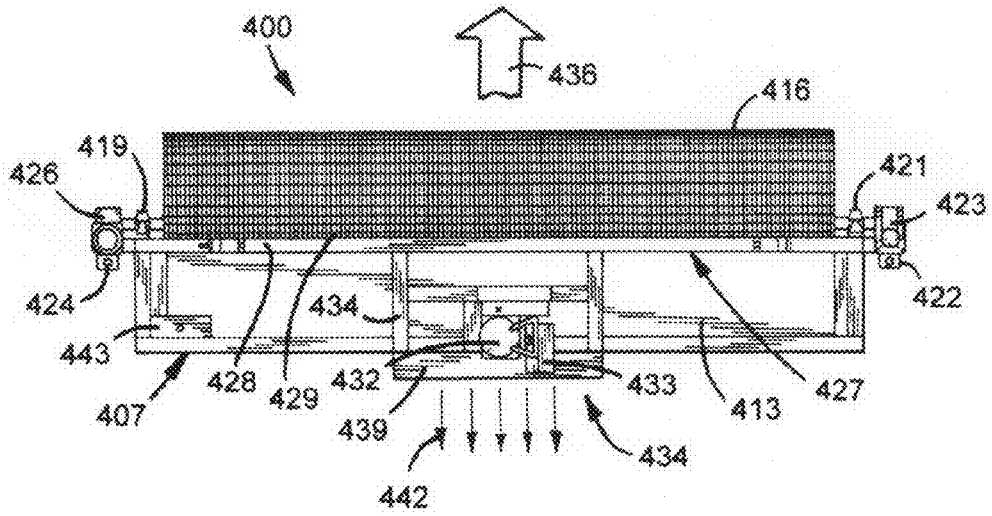
FIG. 16 is a top plan view of the cleaning apparatus of FIG. 15.
Figure 17:
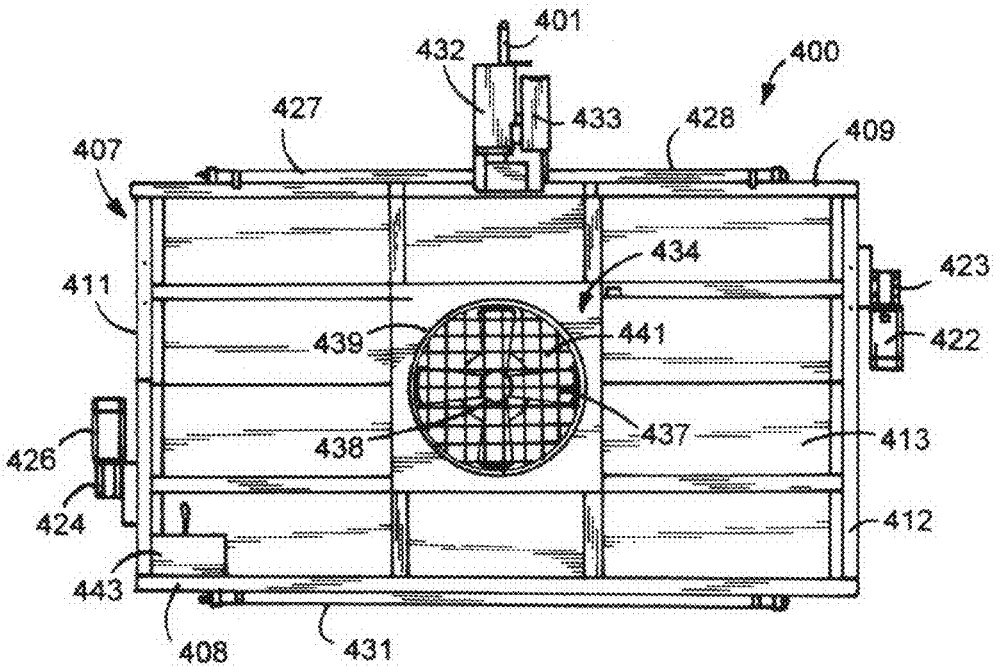
FIG. 17 is a front elevational view of the cleaning apparatus of FIG. 15.

A fourth embodiment of the cleaning apparatus 400, shown in FIGS. 15 to 17, is pendently supported with a cable 401 from a davit 402 located on a building 403 including an upright wall 404 and a roof 406. Cleaning apparatus 400 has a frame 407 comprising horizontal frame members 408 and 409 connected to upright frame members 411 and 412. An arcuate shield 413 secured to frame member 407 is located adjacent an inside circumferential portion of cleaning elements or brushes 414 and 416. Each brush 414 and 416 has a plurality of outwardly extended vanes 417 mounted on a cylindrical body 418. The structure of brush 117 shown in FIGS. 8 and 9 is the same as brushes 414 and 416. Brush 414 is rotatably mounted for rotation about a horizontal axis on bearings 419 and 421 secured to upright frame members 411 and 412. An electric motor 422 drives a power transmission or gear box 423 operatively connected to brush 414 whereby on operation of motor 422 brush 414 is rotated about a horizontal axis. Brush 416 located generally parallel and below brush 414 is also rotatably mounted on frame 407. The rear sections of brushes 414 and 416 are located adjacent shield 413 to confine air and liquids to the areas around brushes 414 and 416. An electric motor 424 drivably coupled to a power transmission or gear box 426 mounted on frame 407 is operable to rotate brush 416 about a generally horizontal axis. Motors 422 and 424 are operable to rotate brushes 414 and 416 in opposite rotational directions or the same rotational directions.

A liquid applicator 427 mounted on frame member 407 above brush 416. Applicator 427 includes an elongated tube 428 supporting a plurality of nozzles 429 operable to spray liquid, such as deionized water, to the surface 404 to be cleaned with brush 416. Applicator 427 is connected to a source of liquid under pressure, such as a pump. A second liquid applicator 431 is mounted on bottom frame member 408.

The cleaning apparatus 400 is moved up and down relative to an upright surface of a structure with a grip style winch 432 connected to cable 401. A DC electric motor 433 coupled to winch 432 operates winch 432 to selectively wind and unwind cable 401 to move cleaning apparatus 400 along the surface 404 during cleaning of the surface 404. Other types of winches and cable pulling devices can be used with cable 401 to move cleaning apparatus 400. An elongated strap or chain can be used to pendently support cleaning apparatus 401. Winch 432 and motor 433 are mounted on frame members 434 whereby the motor driven winch 432 on frame 407 is operable to move cleaning apparatus 400 relative to surface 404 during cleaning of the surface. Motor 433 is coupled to a source of electric power with an electric cord and a manually operated control unit to regulate the speed, direction of operation and ON and OFF conditions of motor 433. A remote wireless control can be used to regulate the operation of motor 433.

A counterforce generator 434 mounted on frame 407 establishes a counterforce or counter thrust, shown in FIGS. 15 and 16, by arrow 436 that continuously maintains brushes 414 and 416 in effective cleaning engagement with the surface 404 being cleaned. As shown in FIG. 17, force generator 434 comprises a rotatable fan 437 driven with an electric motor 438. Fan 437 is positioned within a cylindrical shroud 439 mounted on frame 407. A screen 441 attached to shroud 439 is located over the air outlet of shroud 439. Fan 437 when rotated by motor 438 dispenses air outwardly from cleaning apparatus 400 as shown by arrows 442 in FIG. 15. The air moved by fan 437, shown by arrows 442, establishes a continuous counterforce, shown by arrow 436 opposite the direction of movement of the air discharged by fan 437 on brushes 414 and 416. This counterforce is generally horizontal and perpendicular to the surface 404 being cleaned with brushes 414 and 416. The counterforce is a counter thrust that maintains brushes 414 and 416 in continuous effective cleaning engagement with the surface 404 being cleaned during movement of cleaning apparatus 400 along the surface 404 being cleaned. The axis of rotation of fan 437 is located between the horizontal planes of the axes of rotation of brushes 414 and 416 whereby the counterforce does not alter the perpendicular cleaning engagement of brushes 414 and 416 relative to the surface 404 being cleaned. Counterforce generator 434 can include a plurality of motor driven fans mounted on frame 407 as shown by generator 204 in FIG. 10.

A remote wireless signal receiver 443 mounted on frame 407 is part of a wireless remote control system used by the operator of cleaning apparatus 400 to control the operation of motors 422, 424 and 438. The operator can change the speed and direction of rotation of winch motor 433 to alter the rate and direction of movement of cleaning apparatus 400. The operator can also change the speed of operation of motor 438 to regulate the counterforce established by counterforce generator 434.

Blowers, air pumps, and air and gas movers can be used as a counterforce generator to provide a substantially perpendicular continuous force on a cleaning brush to maintain the brush in continuous effective contact with the surface being cleaned. This prevents separation of the brushes 416 and 418 from the surface being cleaned due to wind, air currents, mullions, window frames and other building structures.

Counterforce generator 434 can be provided with one or more movable air outlets, vanes, rudders or nozzles to direct air in selected lateral, horizontal and vertical directions to adjust the direction of the counterforce on brushes 416 and 418 to maintain the brushes 416 and 418 in an effective continuous cleaning engagement with the surface being cleaned. Generator 434 can be mounted on frame 407 in adjustable horizontal and vertical locations with adjustable brackets.

The above description and drawings of the several embodiments of the cleaning apparatus may be modified and altered by persons skilled in the art within the scope and context of the invention defined in the appended claims and their equivalents.

The invention claimed is:

1. A cleaning apparatus for cleaning a generally vertically extending exterior surface of a building comprising:

a davit adapted to be located on the building above the generally vertically extending exterior surface of the building;

a cleaning unit;

a cable connected to the davit and cleaning unit for pendently suspending the cleaning unit adjacent the exterior surface of the building;

the cleaning unit includes a frame;

at least one generally horizontal cleaning element disposed on the frame and configured to rotate about a generally horizontal axis;

said cleaning element having a plurality of outwardly extending cleaning vanes operable to contact the generally vertical extending exterior surface of the building during the cleaning operation;

a first motor mounted on the frame operable to rotate the cleaning element about the generally horizontal axis;

a winch mounted on the frame and operably connected to the cable to control movement of the cleaning unit in vertical directions relative to the exterior surface of the building during a cleaning operation;

a second motor drivably connected to the winch operating the winch to control movement of the cleaning unit in vertical directions relative to the exterior surface of the building during a cleaning operation;

a liquid applicator mounted on the frame operable to dispense a liquid onto the generally vertically extending exterior surface of the building during the cleaning operation;

a rigid pole secured to the frame and extended generally horizontally outward from the frame away from the exterior surface of the building;

a weight disposed on the pole to provide a downward pivotal force on the frame that balances the weight of the frame and cleaning unit to assist in maintaining the cleaning element in engagement with the exterior surface of the building during the cleaning operation;

a counterforce system mounted on the frame operable in conjunction with the pole and weight on the pole to provide a substantially perpendicular continuous force on the frame and cleaning element towards the generally vertically extending exterior surface to maintain the cleaning vanes of the cleaning element in substantially continuous contact with the generally vertically extending exterior surface of the building during the cleaning operation;

the counterforce system including a fan mounted on the frame for rotation about a horizontal axis generally perpendicular to the horizontal axis of rotation of the cleaning element, said axis of rotation of the fan being located in substantially the same horizontal plane as the axis of rotation of the cleaning element whereby the location of the fan on the frame does not alter the location of the cleaning element relative to the exterior surface of the building during the cleaning operation;

a shield mounted on the frame between the cleaning element and counterforce system to confine air and liquid to the space accommodating the cleaning element and adjacent exterior surface of the building;

a third motor connected to the fan to rotate the fan to move air away from the frame and cleaning element to establish said force on the frame and cleaning element; and a remote control unit operable to regulate the operation of the third motor to control the rotational speed of the fan to regulate the amount of the force on the frame and cleaning element;

said remote control unit including a wireless signal receiver mounted on the frame and a wireless control useable by an operator to control the operation of the third motor to adjust the force on the frame and cleaning element to maintain the cleaning element in cleaning engagement with the exterior surface of the building.

2. The cleaning apparatus of claim 1 wherein:

the counterforce system includes a plurality of fans mounted on the frame for rotation about horizontal axes generally perpendicular to the horizontal axis of rotation of the cleaning element, said axes of rotation of the fans being located in substantially the same horizontal plane as the axis of rotation of the cleaning element, and motors including the third motor connected to the one fan to rotate the fans to establish said force on the frame and cleaning element.

3. The cleaning apparatus of claim 1 wherein:

the pole extends generally horizontally outwardly from the frame; and the weight is disposed on an end portion of the pole.

4. The cleaning apparatus of claim 1 wherein:

said shield comprises an arcuate member secured to the frame adjacent the cleaning element to confine air and liquid to the space around the cleaning element and adjacent the exterior surface of the building.

5. The cleaning apparatus of claim 1 wherein:

said liquid comprises deionized water for cleaning contaminants from the generally vertically extending exterior surface.

6. An apparatus for cleaning an upright surface of a structure comprising:

a frame;

at least one cleaning element rotatably mounted on the frame for rotation about a generally horizontal axis operable to contact and clean the upright surface of the structure;

supports rotatably mounting the cleaning element on the frame for rotation about the generally horizontal axis;

a first motor operably connected to the cleaning element to rotate the cleaning element about the generally horizontal axis;

at least one liquid applicator mounted on the frame above the cleaning element operable to dispense a liquid toward the upright surface of the structure;

a davit mountable on the structure having the upright surface above the frame;

an elongated flexible member connected to the davit extended downwardly adjacent the upright surface of the structure;

a winch mounted on the frame operably connected to the flexible member, a second motor mounted on the frame operably connected to the winch whereby on operation of the second motor the winch controls vertical movement of the frame, cleaning element and liquid applicator relative to said upright surface of the structure thereby cleaning said upright surface of the structure;

a counterforce system mounted on the frame operable to provide a substantially horizontal continuous force on the frame and cleaning element perpendicular to the upright surface to maintain the cleaning element in cleaning engagement with said surface of the structure during the vertical movement of the cleaning element relative to said surface of the structure;

the counterforce system including at least one fan;

said fan being mounted on the frame for rotation about a horizontal axis generally perpendicular to the horizontal axis of rotation of the cleaning element, said axis of rotation of the fan being located in substantially the same horizontal plane as the axis of rotation of the cleaning element whereby the location of the fan on the frame does not alter the location of the cleaning element relative to the surface of the structure;

a third motor connected to the fan to rotate the fan to move air away from the frame and cleaning element to establish said force on the frame and cleaning element; and a control unit operable to regulate the third motor to control the rotational speed of the fan thereby varying the force on the frame and cleaning element.

7. The cleaning apparatus of claim 6 wherein:

the counterforce system includes a plurality of fans mounted on the frame for rotation about horizontal axes generally perpendicular to the horizontal axis of rotation of the cleaning element, said axes of rotation of the fans being located in substantially the same horizontal plane as the axis of rotation of the cleaning element, and motors including the third motor connected to the one fan to rotate the fans to establish said force on the frame and cleaning element.

8. The cleaning apparatus of claim 6 including:

at least one weight mounted on the frame outwardly of the cleaning element to counterbalance the frame and cleaning element and retain the cleaning element in conjunction with the force established by the fan in continuous engagement with the upright surface of the structure.

9. The cleaning apparatus of claim 6 including:

a shield mounted on the frame between the cleaning element and counterforce system to confine air and liquid to the space accommodating the cleaning element and adjacent upright surface of the structure.

10. The cleaning apparatus of claim 6 wherein:

said control unit includes a remote control system with a wireless receiver mounted on the frame and a wireless control useable by an operator to control the operation of the third motor to regulate the rotational speed of the fan thereby to vary the force on the frame and cleaning element to maintain the cleaning element in engagement with the upright surface of the structure.

11. The cleaning apparatus of claim 6 wherein:

said liquid comprises deionized water for cleaning contaminants from the upright surface of the structure.

12. An apparatus for cleaning a generally upright surface of a structure having a davit mounted on the structure above the upright surface of the structure comprising:

a cleaning unit movable relative to the upright surface of the structure for cleaning the upright surface of the structure, the cleaning unit having a frame, at least one generally horizontal cleaning element, means rotatably mounting the cleaning element on the frame for rotation about a horizontal axis, a first motor mounted on the frame operable to rotate the cleaning element about the horizontal axis, a winch mounted on the frame, said winch including a cable adapted to be connected to the davit to pendently suspend the cleaning unit adjacent the upright surface of the structure, a second motor drivably connected to the winch to operate the winch to control movement of the cleaning unit relative to the upright surface of the structure, a liquid applicator mounted on the frame operable to dispense a liquid onto the upright surface of the structure adjacent the cleaning element during the cleaning operation, a force system mounted on the frame operable to provide substantially continuous force on the frame and cleaning element towards the upright surface of the structure to maintain the cleaning element in substantially continuous engagement with the upright surfaces of the structure during the cleaning operation, said force system including at least one ranting fan mounted on the frame, the fan being mounted on the frame to rotate about an axis generally perpendicular to the horizontal axis of rotation of the cleaning element, said axis of rotation of the fan being located in substantially the same horizontal plane as the axis of rotation of the cleaning element whereby the location of the fan on the frame does not alter the location of the cleaning element relative to the upright of the building during the cleaning operation;

a third motor connected to the fan to rotate the fan to move air away from the frame and cleaning element to establish said force on the frame and cleaning element to maintain the cleaning element in substantially continuous engagement with the upright surface of the structure during the cleaning operation, and a control unit operable to regulate the operation of the third motor to control the rotational speed of the fan to vary the amount of the force on the frame and cleaning element.

13. The apparatus of claim 12 wherein:

the control unit includes a wireless signal receiver mounted on the frame operable to regulate the operating speed of the third motor, and a wireless control useable by an operator to remotely control the signal receiver to regulate the operating speed of the third motor to vary the force on the frame and cleaning element towards the upright surface of the structure.

14. The apparatus of claim 13 wherein:

the control unit is also operable to regulate the operation of the second motor to control the rate of movement of the cleaning unit relative to the vertical surface of the building.

15. An apparatus for cleaning a generally upright surface of a structure having a davit mounted on the structure above the upright surface of the structure comprising:

a cleaning unit movable relative to the upright surface of the structure for cleaning the upright surface of the structure, the cleaning unit having a frame, at least one generally horizontal cleaning element, means rotatably mounting the cleaning element on the frame for rotation about a horizontal axis, a first motor operable to rotate the cleaning element about the horizontal axis, a winch, said winch including a cable adapted to be connected to the davit and cleaning unit to pendently suspend the cleaning unit adjacent the upright surface of the structure, a second motor drivably connected to the winch to operate the winch to control movement of the cleaning unit relative to the upright surface of the structure, a liquid applicator mounted on the frame operable to dispense a liquid onto the upright surface of the structure adjacent the cleaning element during the cleaning operation, a force system mounted on the frame operable in conjunction with weight of the cleaning unit to provide a substantially continuous force on the frame and cleaning element towards the upright surface of the structure to maintain the cleaning element in substantially continuous engagement with the upright surfaces of the structure during the cleaning operation, said force system including at least one rotating fan mounted on the frame, the fan being mounted on the frame to rotate about an axis generally perpendicular to the horizontal axis of the cleaning element, said axis of rotation of the fan being located in substantially the same horizontal plane as the axis of rotation of the cleaning element whereby the location of the fan on the frame does not alter the location of the cleaning element relative to the upright surface of the building during the cleaning operation, a third motor connected to the fan to rotate the fan to move air away from the frame and cleaning element to establish said force on the frame and cleaning element to maintain the cleaning element in conjunction with the pole and weight in substantially continuous engagement with the upright surface of the structure during the cleaning operation, and a control unit operable to regulate the operation of the third motor to control the rotational speed of the fan to vary the amount of the force on the frame and cleaning element.

16. The apparatus of claim 15 wherein:

the control unit includes a wireless signal receiver mounted on the frame operable to regulate the operating speed of the third motor, and a wireless control useable by an operator to remotely control the signal receiver to regulate the operating speed of the third motor to vary the force on the frame and cleaning element towards the upright surface of the structure.

17. The apparatus of claim 15 wherein:

the control unit is also operable to regulate the operation of the second motor to control the rate of movement of the cleaning unit relative to the upright surface of the structure.

18. The apparatus of claim 15 including:

a shield comprising an arcuate member secured to the frame adjacent the cleaning element to confine air and liquid to the space around the cleaning element and adjacent the exterior surface of the structure.

19. The apparatus of claim 15 wherein:

said liquid comprises deionized water.

20. The apparatus of claim 15 wherein:

the force system includes a plurality of fans mounted on the frame for rotation about horizontal axes generally perpendicular to the horizontal axis of rotation of the cleaning element, said axes of rotation of the fans being located in substantially the same horizontal plane as the axis of rotation of the cleaning element, and motors including the third motor connected to the one fan to rotate the fans to establish said force on the frame and cleaning element.

* * * * *